US008917179B2

(12) United States Patent
Alicot et al.

(10) Patent No.: US 8,917,179 B2
(45) Date of Patent: Dec. 23, 2014

(54) SYSTEM AND METHOD FOR DETECTING PRESENCE OF AN OBJECT

(71) Applicants: Jorge F. Alicot, Davie, FL (US); Mohammad Mohiuddin, Boynton Beach, FL (US)

(72) Inventors: Jorge F. Alicot, Davie, FL (US); Mohammad Mohiuddin, Boynton Beach, FL (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 171 days.

(21) Appl. No.: 13/786,962

(22) Filed: Mar. 6, 2013

(65) Prior Publication Data

US 2013/0257617 A1 Oct. 3, 2013

Related U.S. Application Data

(60) Provisional application No. 61/618,130, filed on Mar. 30, 2012.

(51) Int. Cl.
*G08B 13/14* (2006.01)
*G08B 13/24* (2006.01)

(52) U.S. Cl.
CPC ..... *G08B 13/2482* (2013.01); *G08B 13/2417* (2013.01); *G08B 13/2448* (2013.01)
USPC ..... 340/572.1; 340/10.1; 340/505

(58) Field of Classification Search
None
See application file for complete search history.

(56) References Cited

U.S. PATENT DOCUMENTS

| | | | | |
|---|---|---|---|---|
| 6,356,197 | B1 * | 3/2002 | Patterson et al. | 340/572.1 |
| 2005/0040950 | A1 | 2/2005 | Clucas | |
| 2006/0273902 | A1 * | 12/2006 | Shafer et al. | 340/572.1 |
| 2008/0204247 | A1 * | 8/2008 | Lian et al. | 340/572.3 |

FOREIGN PATENT DOCUMENTS

| | | | |
|---|---|---|---|
| WO | 0175785 | A2 | 10/2001 |
| WO | 0175785 | A3 | 10/2001 |

OTHER PUBLICATIONS

EPO International Search Report dated Jun. 13, 2013 for corresponding appln PCT/US13/033710.

* cited by examiner

*Primary Examiner* — Travis Hunnings
(74) *Attorney, Agent, or Firm* — Dean D. Small; The Small Patent Law Group

(57) ABSTRACT

A system for detecting the presence of an object may include a radio frequency identification (RFID) reader configured to transmit a plurality of interrogation signals, a response controller that is configured to receive the plurality of interrogation signals and respond by transmitting a plurality of standard response signals, and a mixing element that is configured to generate a mixed signal when in the presence of the plurality of interrogation signals and the standard response signals. The RFID reader outputs an alert signal upon receipt of the mixed signal.

18 Claims, 3 Drawing Sheets

SYSTEM AND METHOD FOR DETECTING PRESENCE OF AN OBJECT

CROSS REFERENCE TO RELATED APPLICATIONS

The present application claims priority to and benefit of U.S. Provisional Application No. 61/618,130, filed on Mar. 30, 2012, and entitled "System and Method for Detecting Presence of an Object," which is hereby incorporated by reference in its entirety.

BACKGROUND OF THE INVENTION

Embodiments of the present disclosure generally relate to a system and method of detecting the presence of an object, such as merchandise within a retail establishment. Embodiments of the present disclosure relate to systems and methods of theft detection and deterrence, for example.

Various businesses track products through the use of radio-frequency identification (RFID) systems. For example, RFID systems may be used to track products for purposes of inventory, logistics, and the like.

An RFID system is typically a wireless, non-contact system that uses radio-frequency (RF) electromagnetic fields to transfer data from a tag or label attached to an object in order to identify and track the object. Unlike a bar code, an RFID tag, which may be embedded within an object, does not need to be within an area of sight of an RFID reader. In the retail clothing industry, for example, RFID tags may be secured to articles of clothing, for example.

Typically, an RFID system includes tags or labels attached to the objects that are to be tracked and identified. Two-way radio transmitter-receivers, such as interrogators or readers, send signals to the tag and read the response from the tag. The readers typically transmit observations regarding the tag or label to a computer system running RFID software, for example.

Information may be stored electronically in a non-volatile memory of the tag. The RFID tag includes a small RF transmitter and receiver. An RFID reader transmits an encoded radio signal to interrogate the tag. The tag receives the message and responds with identification information. The identification information may be a unique tag serial number, or product-related information such as a stock number, lot or batch number, production date, or other specific information.

RFID tags may be either passive, active, or battery assisted passive. An active RFID tag typically includes an on-board battery that periodically transmits an ID signal. A battery assisted passive (BAP) typically includes a small battery that is activated when in the presence of an RFID reader. A passive RFID tag typically does not include a battery. Instead, the tag uses RF energy transmitted by the reader as its energy source.

Because RFID tags have individual serial numbers, the RFID system is able to discriminate among several tags that are within the range of the RFID reader. In general, RFID tags may include an integrated circuit for storing and processing information, modulating and demodulating a radio-frequency (RF) signal, collecting direct current power from the incident reader signal, and other specialized functions, and an antenna for receiving and transmitting the signal.

While businesses often track products for purposes of inventory, logistics, and the like through the use of RFID systems, many businesses also utilize separate and distinct theft-detection systems. For example, many retail stores include theft-detection systems proximate the entrance/exit of the particular stores.

Electronic article surveillance (EAS) systems are often used to prevent theft and similar unauthorized removal of articles from a controlled area. Typically, a system transmitter and a system receiver are used to establish a surveillance zone, which must be traversed by any article being removed from the controlled area.

An EAS tag is affixed to each article and includes a marker or sensor adapted to interact with a signal that is transmitted by the system transmitter into the surveillance zone. The interaction causes a further signal to be established in the surveillance zone, which is received by the system receiver. Accordingly, upon movement of a tagged article through the surveillance zone, a signal is received by the system receiver, identifying the unauthorized presence of the tagged article in the zone. Unlike an RFID tag, which is configured to transmit data, an EAS tag typically provides a disturbance or response to an electric or magnetic field.

Typically, a business that wishes to track inventory and provide theft detection and deterrence employs separate and distinct systems for each. For example, the business may include an RFID system for inventory and logistics, and an EAS system for theft detection and deterrence. However, employing two separate and distinct systems increases costs.

In the past, RFID and EAS tags have been combined into a common enclosure. However, the RFID and EAS tags operate separately and distinctly from one another, and typically require separate and distinct RFID and EAS detection systems, respectively, to detect their presence. In general, typical EAS systems are incompatible with radio frequency ranges that are used with high and ultra-high frequency RFID systems.

BRIEF DESCRIPTION OF THE INVENTION

Certain embodiments of the present disclosure provide a system for detecting the presence of an object. The system may include a radio frequency identification (RFID) reader configured to transmit a plurality of interrogation signals, a response controller, such as an electric field ("E-field") RFID response controller, that is configured to receive the plurality of interrogation signals and respond by transmitting a plurality of standard response signals, and a mixing element that is configured to generate a mixed signal when in the presence of the plurality of interrogation signals and the standard response signals. The RFID reader may output an alert or event signal upon receipt of the mixed signal, and report an event that triggered the alert through a communication channel.

The plurality of standard response signals may be modulated. The plurality of standard response signals may be transmitted at a low frequency, such as between 100-250 kHz, and the plurality of interrogation signals may be transmitted at an ultra-high frequency, such as between 100-1000 MHz.

The mixed signal may be a mix of the plurality of standard response signals and the plurality of interrogation signals.

The system may also include at least one detection member configured to generate one or both of an electric or magnetic field. The detection members may include metal plates and/or loop antennas configured to generate an electric and/or magnetic field. The detection members(s) may be operatively connected to the response controller.

The system may also include a tag. The mixing element may be encased within the tag. The tag may also include an RFID tag or element. Optionally, the mixing element may be part of a label on a product or product packaging. The mixing element may be part of an electronic article surveillance (EAS) microwave tag.

The RFID reader and the response controller may be contained within a common housing.

Certain embodiments of the present disclosure provide a method of detecting the presence of an object. The method may include using an RFID reader to transmit a plurality of interrogation signals, receiving the plurality of interrogation signals at a response controller, using the response controller to transmit a plurality of standard response signals upon reception of the plurality of interrogation signals, disregarding the standard response signals, generating a mixed signal when a mixing element is in the presence of the plurality of interrogation signals and the plurality of standard response signals, and outputting an alert signal through the RFID reader upon receipt of the mixed signal.

DETAILED DESCRIPTION OF THE INVENTION

Figure 1:
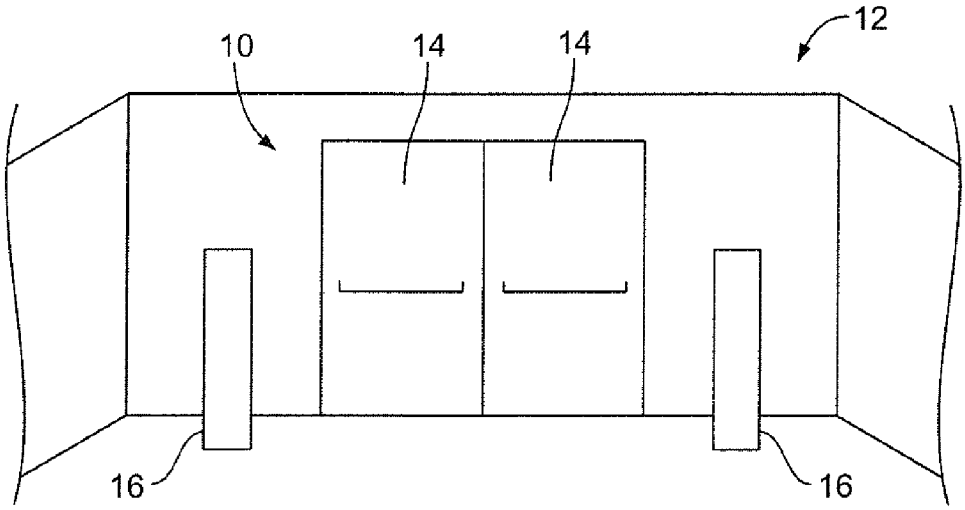
FIG. 1 illustrates an isometric view of a front entrance of an establishment, according to an embodiment of the present disclosure.

FIG. 1 illustrates an isometric view of a front entrance 10 of an establishment 12, according to an embodiment of the present disclosure. The establishment 12 may be a retail store, for example. The front entrance 10 includes one or more doors 14 that permit individuals to enter and exit the establishment. Within the establishment, opposed detection members 16, such as posts, panels, or the like, are positioned proximate the doors 14. Optionally, the opposed detection members 16 may be a doorway or threshold through which an individual may pass. Thus, an individual passes between the detection members 16 before exiting through the doors 14. The detection members 16 may include metal plates configured to generate an electric field therebetween. Optionally, the detection members 16 may include wire coils configured to generate a magnetic field.

The detection members 16 may include an RFID reader and a response controller, such as an E-field RFID response controller, as described below.

Figure 2A:
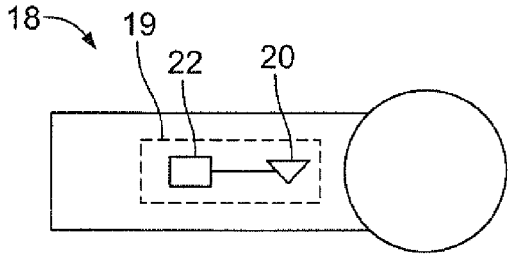
FIG. 2*a* illustrates a simplified view of a tag, according to an embodiment of the present disclosure.

FIG. 2*a* illustrates a simplified view of a tag 18, according to an embodiment of the present disclosure. The tag 18 is configured to be attached to an article for sale, such as an article of clothing, and may be an EAS microwave tag, label, or the like. The tag 18 may include an inlay 19 that contains or otherwise supports an internal antenna 20 connected to a mixing element 22. The element 22 may be a non-linear element, such as a diode or variable capacitor that changes characteristics based on an applied voltage. For example, as the tag 18 passes by or between the opposed detection members 16, the electric or magnetic field generated between the opposed detection members 16 may cause the mixing element 22 to change characteristics. In an embodiment, as the tag 18 enters the presence of different electric or magnetic fields, the mixing element 22 may generate a separate and distinct signal based on the signaling of the response controller.

The tag 18 may also include an RFID tag inlay, which may be detected by an RFID reader. Optionally, instead of being secured within a tag 18, the inlay 19 having the mixing element 22 and the antenna 20 may be integrally secured to an article for sale, and/or assembled in a paper or plastic label. For example, the inlay 19 may be secured to a box, packaging, or the like that contains a product for sale.

Figure 2B:
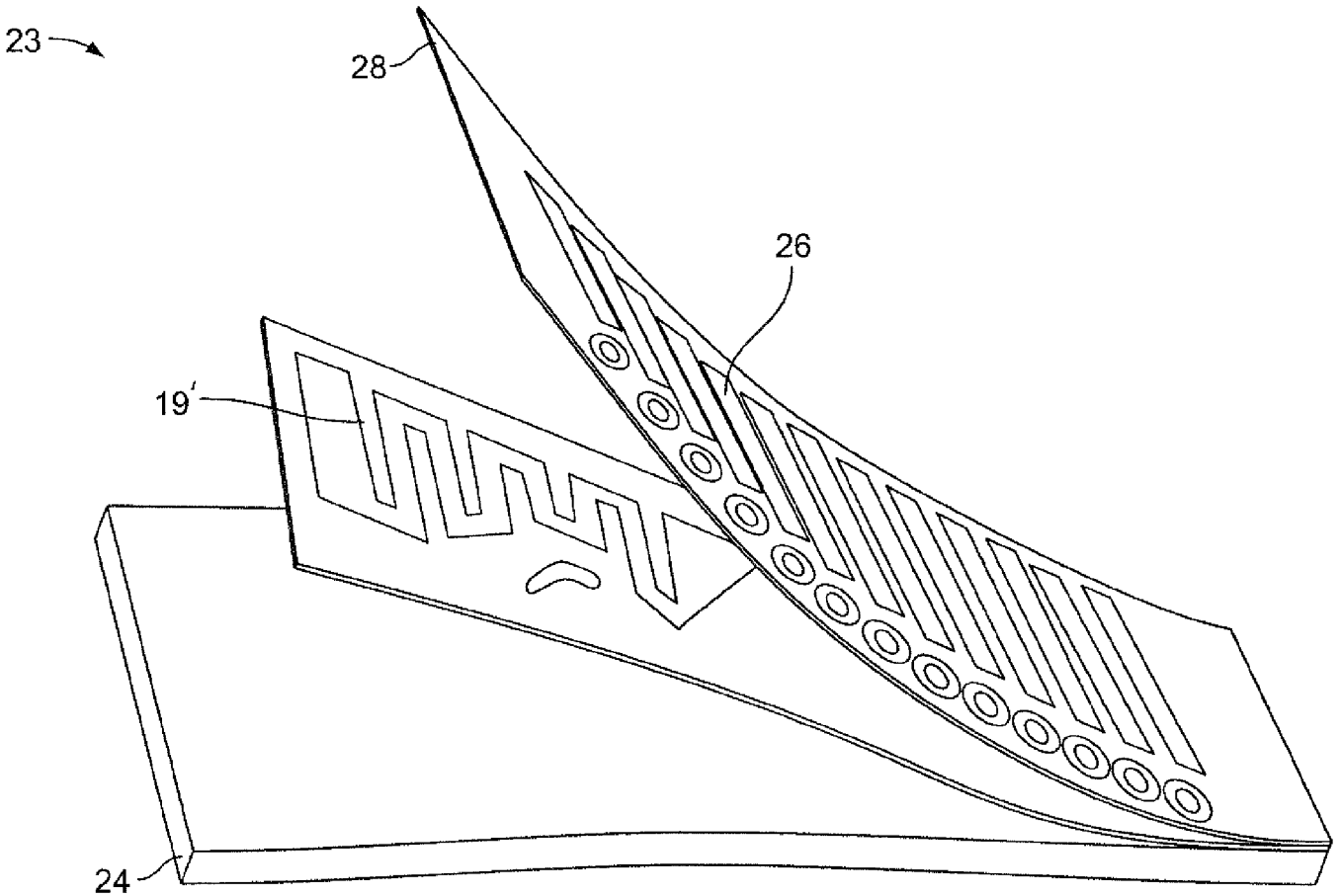
FIG. 2*b* illustrates an inlay formed with a label, according to an embodiment of the present disclosure.

FIG. 2*b* illustrates an inlay 19' formed with a label 23, according to an embodiment of the present disclosure. The inlay 19' may include a mixing element and antenna, as described above. The inlay 19' is supported on a substrate 24, such as through an adhesive liner. The inlay 19' may be overlaid with a bar code strip 26, which may include an adhesive layer 28 on a lower surface. As such, the inlay 19' may be compressively and adhesively sandwiched between the bar code strip 26 and the substrate 24.

Figure 3:
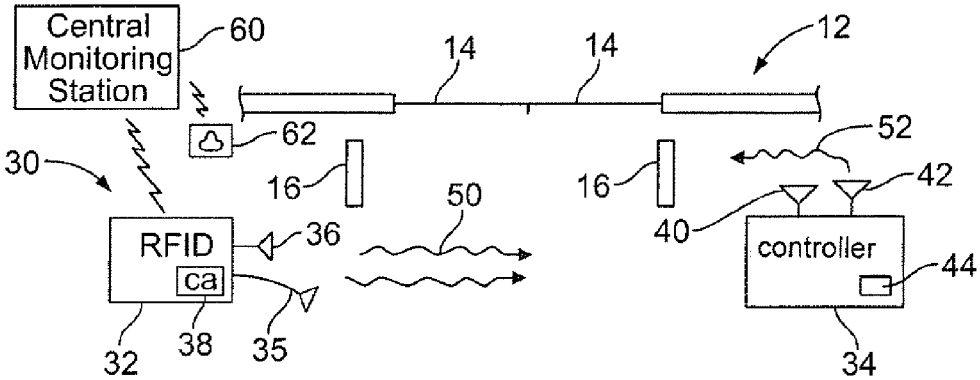
FIG. 3 illustrates a block diagram of an object detection system, according to an embodiment of the present disclosure.

FIG. 3 illustrates a block diagram of an object detection system 30, according to an embodiment of the present disclosure. The system 30 may include an RFID reader 32 and a signal or field generator 34, which may be, for example, an E-field RFID response controller. The RFID reader 32 and the signal or field generator 34 may be the opposed detection members 16 (shown in FIG. 1), for example. The RFID reader 32 may include a transmitter 35 and a receiver 36. The transmitter 35 is configured to transmit ultra-high frequency querying signals over a first band or channel. For example, the transmitter 35 may transmit querying signals at a frequency of 915 MHz, for example. The receiver 36 is configured to receive signals transmitted from RFID tags, for example, and from a mixing element, which may be an EAS tag, such as the mixing element 22 (shown in FIG. 2*a*). The transmitter 35 and the receiver 36 are operatively connected to a processing unit 38 (such as a microprocessor, microcontroller, integrated circuit, and/or the like), which may include a memory, or may be operatively connected to separate and distinct memory. The RFID reader 32 may be housed within, or server as, one of the detection members 16. Optionally, the RFID reader 32 may be at various other locations within the establishment 12. For example, the RFID reader 32 may be secured to a ceiling of the establishment 12 over the detection members 16.

The response controller 34 includes a receiving antenna 40 and a transmitting antenna 42, both of which are operatively connected to a processing unit 44. Optionally, the receiving and transmitting antennas 40 and 42 may be integrated into a single structure. The processing unit 44 may include, or be separately connected to, a memory. The response controller 34 may be housed within, or serve as, one of the detection members 16. Optionally, the response controller 34 may be at various other locations within the establishment 12. For example, the response controller 34 may be secured to a ceiling of the establishment 12 over the detection members 16. Additionally, the response controller 34 and the RFID reader 30 may be secured within a common housing.

In operation, the response controller 34 generates a low frequency signal over a second band or channel that differs from the first band or channel. The low frequency signal may generate one or both of an electric or magnetic field between the detection members 16. For example, the response controller 34 may be directly wired to metal plates within the detection members 16 to produce an electric field. Alternatively, the response controller 34 may be directly wired to wire coils that are configured to generate a magnetic field. Also, alternatively, the response controller 34 may produce an electric and/or magnetic field in the metal plates or coils through transmission of a modulated, low frequency standard response signal 52 transmitted through the antenna 42. The response controller 34 may modulate the generated low frequency standard signal between on and off states.

The RFID reader 30 transmits interrogation signals 50 that are received by the receiving antenna 40 of the response controller 34. The response controller 34 transmits the modulated low frequency standard response signals 52 back to the RFID reader 30. As noted above, the response controller 34 modulates a low-frequency signal that selectively activates and deactivates the electric or magnetic field between the detection members 16. When the low frequency standard signal is active, the electric or magnetic field is active. When the low frequency signal is turned off, the electric or magnetic field is inactive. As such, the RFID reader 32 receives a series of signals from the transmitter 42 of the response controller 34. In this manner, the response controller 34 acts as an RFID tag simulator in that the RFID reader 32 receives a series of signals that are akin to data signals transmitted from an RFID tag. For example, the response controller 34 may modulate the low frequency standard signals 52 so that they are received by the RFID reader 32 similar to an RFID response signal from an RFID tag, such as an RN16 (random number with 16 bits) signal.

When the tag 18 (shown in FIG. 2) is not in the presence of the electric of magnetic field, the response controller 34, in response to the interrogation signals 50 transmitted from the RFID reader 32, transmits the low frequency standard response signals 52 at a particular frequency to the RFID reader 32. The response signals 52 are at a frequency, however, that the RFID reader 32 is designed and/or programmed to ignore (or otherwise not receive or acknowledge). For example, the response signals 52 may be at 250 kHz. However, the response signals may be at various other frequencies. Accordingly, the RFID reader 32 does not transmit an alert or event signal to a central computer station within, or remote from, the establishment 12.

The RFID reader 32 may also be in communication with a central monitoring station 60, such as a main computer of the establishment 12. The RFID reader 32 may be configured to send alert or event signals to the central monitoring station 60 when the RFID reader 32 detects the presence of a mixed signal or field, as explained below.

Referring to FIGS. 2 and 3, when the tag 18 enters the electric or magnetic field between the detection members 16, the mixing element 22 is affected by the ultra-high frequency signals 50 transmitted by the RFID reader 32, and the low frequency signals 52 transmitted by the response controller 34. For example, the RFID reader 32 may transmit the ultra-high frequency signals 50 at a frequency of 915 MHz, for example, while the response controller 34 may generate low frequency signals 52 at a frequency of 250 kHz, for example. The signals generated by the RFID reader 32 and the response controller 34 may be isolated from one another. For example, the RFID reader 52 may transmit the ultra-high frequency signals 50 over a first band or channel, while the response controller 34 may transmit the low frequency signals 52 over a second band or channel, which differs from the first band or channel.

As the mixing element 22 receives both signals 50 and 52 through the antenna 20, the signals 50 and 52 are combined in the mixing element 22. In response, the mixing element 22 generates a third, mixed signal or field that is transmitted to, or otherwise detected by, the RFID reader 30. The mixed signal or field may be an addition of both signals 50 and 52 (for example, 100 MHz+100 kHz), and a subtraction of both signals 50 and 52 (for example, 100 MHz−100 kHz), with the addition and subtraction signals being mixed together to provide the new, mixed signal. The RFID reader 32 receives the mixed signal from the tag 18 and discriminates it from the non-acknowledged low frequency standard response signal 52 from the response controller 34. Because the response controller 34 constantly modulates the electric or magnetic field, the mixed signal is received by the RFID reader 32 as a series of signals, which the RFID reader 32 interprets as an RFID data response. The RFID reader 32 is programmed to detect and acknowledge the mixed signal and send an alert or event signal to a computer system within, or remote from, the establishment 12. The alert or event signal caused by an event (such as an attempted theft) may then trigger an alarm 62 that the tag 18, which may be secured to article for sale, is leaving the premises.

As noted above, the RFID reader 32 may transmit the alert or event signal regarding the event to the central monitoring station 60. The central monitoring station 60 may then activate the alarm 62. Optionally, upon receipt of the mixed signal, the RFID reader 32 may transmit an alert signal regarding an event that is directly received by an alarm system, which then activates the alarm 62.

Thus, the system 30 may utilize a standard RFID reader 32, which is configured to detect RFID tags, to detect a mixing element, such an EAS microwave tag, without the need for a separate and distinct theft detection and deterrence system. Instead, the RFID reader 32 may operate in a normal fashion, but, with the addition of the response controller 34, may simultaneously be able to detect theft detection and deterrence tags as they are proximate an electric or magnetic field between the detection members 16. Therefore, a business owner may simply utilize a standard RFID system, plus a low-cost response controller 34, to detect and deter theft, without the need for a costly separate and distinct theft detection and deterrence system. The RFID reader 32 is able to detect the mixing element 22, which may be an EAS microwave tag, without the RFID reader 32 varying with respect to a normal mode of operation. That is, the mixing element 22 appears to the RFID reader 32 as an RFID tag, through the modulated electric or magnetic field generated by the response controller 34.

Alternatively, the system 30 may operate without discernable detection members 16. Instead, the RFID reader 32 and the response controller 34 may simply operate as discussed above. The mixing element 22 within the tag 18 may simply generate a mixed signal based on reception of the ultra-high frequency signal transmitted from the RFID reader 32, and the low frequency signal transmitted from the response controller 34. In this manner, the RFID reader 32 and the response controller 34 may be positioned proximate the doors 14 of the establishment 12.

Figure 4:
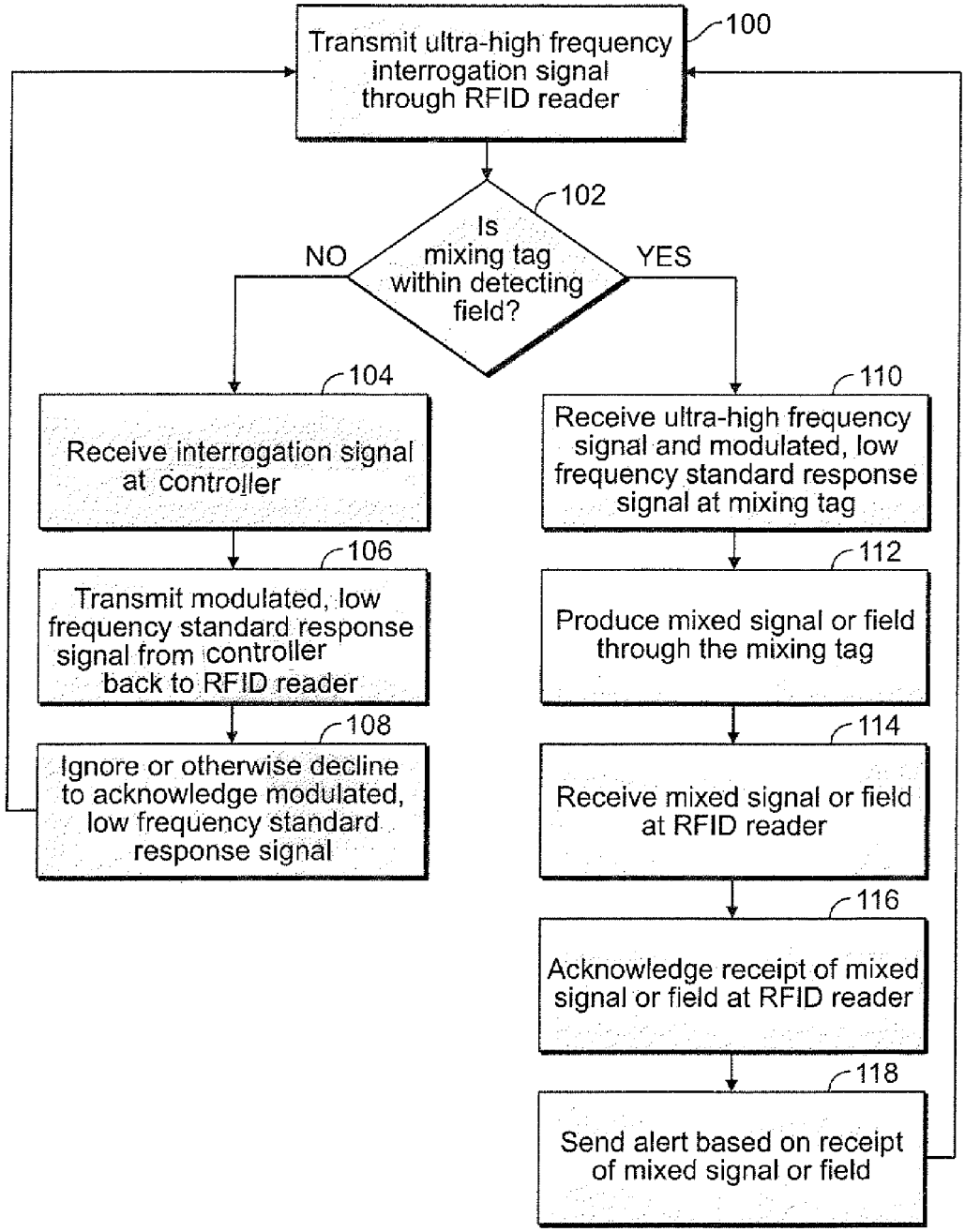
FIG. 4 illustrates a flow chart of a process of operating an object detection system, according to an embodiment of the present disclosure.

FIG. 4 illustrates a flow chart of a process of operating an object detection system, according to an embodiment of the present disclosure. At 100, the RFID reader transmits an ultra-high frequency interrogation signal. The RFID reader may constantly send ultra-high frequency interrogation signals throughout operation.

At 102, it is determined whether the mixing element, such as encased in a tag, or on or within a label of a product package, is within the vicinity of a detecting field. As explained above, the presence of the mixing element is detected when a mixed signal is detected by the RFID reader.

If the mixing element is not within the detecting field, then, at 104, the interrogation signal is received by the response controller. In response, at 106, the response controller transmits a modulated, low frequency standard response signal back to the RFID reader. However, the RFID reader is designed or programmed to disregard the low frequency standard response signal. Thus, at 108, the RFID reader ignores or otherwise declines to acknowledge the modulated, low frequency standard response signal, and the process returns to 100.

If, however, the mixing element is within the detecting field, then at 110, the mixing element receives the ultra-high frequency signal and the modulated, low frequency standard response signal. Upon receiving the two signals, the characteristics of the mixing element, such as a diode or variable capacitor change, and thereby generate a new signal or field, which is a mixed signal or field, at 112. The mixed signal may be, for example, a signal that mixes the sum of the signals and the difference of the signals.

At 114, the mixed signal is then received or otherwise detected at the RFID reader. The RFID reader is designed or programmed to discern and acknowledge the mixed signal. Thus, at 116, the RFID reader acknowledges receipt of the mixed signal or field. Then, at 118, the RFID reader sends an alert (either to the central monitoring station or directly to an alarm system) based on receipt or detection of the mixed signal. An alarm may then be triggered, and the process returns to 100.

Thus, embodiments provide a system and method for detecting the presence of a mixing element, such as an EAS tag, through an RFID reader and a response controller. The RFID reader and the response controller may be housed within a common enclosure. Embodiments provide a system and method that utilizes RFID infrastructure to provide theft detection and deterrence without the need for a separate and distinct system, such as an EAS system. Embodiments provide a system and method in which an RFID reader detects a mixing element, such as an EAS microwave tag, in a similar manner as the RFID reader detects an RFID tag.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A system for detecting the presence of an object, the system comprising:

a radio frequency identification (RFID) reader configured to transmit a plurality of interrogation signals;

a response controller that is configured to receive the plurality of interrogation signals and respond by transmitting a plurality of standard response signals; and a mixing element that is configured to generate a mixed signal when in the presence of the plurality of interrogation signals and the standard response signals, wherein the RFID reader outputs an event or alert signal upon receipt of the mixed signal.

2. The system of claim 1, wherein the plurality of standard response signals are modulated.

3. The system of claim 1, wherein the plurality of standard response signals are transmitted at a low frequency, and wherein the plurality of interrogation signals are transmitted at an ultra-high frequency.

4. The system of claim 1, wherein the mixed signal mixes the plurality of standard response signals and the plurality of interrogation signals.

5. The system of claim 1, further comprising at least one detection member configured to generate one or both of an electric or magnetic field.

6. The system of claim 5, wherein the at least one detection member is operatively connected to the response controller.

7. The system of claim 1, further comprising a tag, wherein the mixing element is encased within the tag.

8. The system of claim 7, wherein the tag further comprises an RFID inlay.

9. The system of claim 1, wherein the mixing element is part of a label on a product or product packaging.

10. The system of claim 1, wherein the mixing element comprises an electronic article surveillance (EAS) microwave element.

11. The system of claim 1, wherein the RFID reader and the response controller are contained within a common housing.

12. A method of detecting the presence of an object, the method comprising:

using an RFID reader to transmit a plurality of interrogation signals;

receiving the plurality of interrogation signals at a response controller;

using the response controller to transmit a plurality of standard response signals upon reception of the plurality of interrogation signals;

disregarding the standard response signals;

generating a mixed signal when a mixing element is in the presence of the plurality of interrogation signals and the plurality of standard response signals; and outputting an alert signal through the RFID reader upon receipt of the mixed signal.

13. The method of claim 11, wherein the using the response controller comprises modulating the plurality of standard response signals.

14. The method of claim 11, further comprising transmitting the plurality of standard response signals at a low frequency, and transmitting the plurality of interrogation signals at an ultra-high frequency.

15. The method of claim 11, wherein the generating the mixed signal comprises mixing the plurality of standard response signals and the plurality of interrogation signals.

16. The method of claim 11, generating one or both of an electric or magnetic field.

17. The method of claim 11, wherein the mixing element is part of a label on a product or product packaging.

18. The method of claim 11, wherein the mixing element comprises an electronic article surveillance (EAS) microwave element.

* * * * *